United States Patent [19]

DeMatteis et al.

[11] Patent Number: 4,821,985

[45] Date of Patent: Apr. 18, 1989

[54] RACK FOR PLASTIC T-SHIRT GROCERY BAGS

[75] Inventors: Robert B. DeMatteis, San Jose, Calif.; Wayne A. Pflueger, Salt Lake City, Utah

[73] Assignee: Cupples Paper Bag Company, LaMirada, Calif.

[21] Appl. No.: 185,634

[22] Filed: Apr. 26, 1988

[51] Int. Cl.[4] ..... A63B 55/04

[52] U.S. Cl. ..... 248/97; 211/12; 248/99

[58] Field of Search ..... 248/97, 99, 100, 95, 248/175; D34/6; 232/43.1, 43.2; 211/12, 71, 59.1, 57.1

[56] References Cited

U.S. PATENT DOCUMENTS

| | | | |
|---|---|---|---|
| 4,620,683 | 11/1986 | Claydon et al. | 248/99 X |
| 4,723,743 | 2/1988 | Jenkins | D34/6 X |
| 4,750,694 | 6/1988 | Bateman | 248/97 |

*Primary Examiner*—Ramon O. Ramirez

*Attorney, Agent, or Firm*—Townsend and Townsend

[57] ABSTRACT

A rack for the counter edge mounting, loading and dispensing of plastic T-shirt grocery bags is disclosed. The bags are of the type formed from an endless tube of plastic having the sides of the bag with a "W" fold. The bottom and the top of the bag are sealed with the top portion cut away to define paired outside bag handles and a bag opening therebetween. The supporting rack includes a flat bottom defining a loading surface on which the sealed bottom of the grocery bag is supported during loading. A vertical or back member extends upwardly from rear portion of the loading surface and has at the topo a wicket supporting protrusion preferably a ball at the end of a wire at the end of a rod. The wicket supporting surface is for supporting bag wall tabs fused together in a wicket. The wicket holding a group of overlying bags together for sequential dispensing and loading. The rack includes a novel second U-shaped member also supported from the vertical member and placed below the first U-shaped member.

3 Claims, 4 Drawing Sheets

RACK FOR PLASTIC T-SHIRT GROCERY BAGS

BACKGROUND OF THE INVENTION

This invention relates to a rack for dispensing T-shirt grocery bags. More particularly an improved rack is disclosed having both safety features and improved bag dispensing of multiple bags

SUMMARY OF THE PRIOR ART

T-shirt bags are dispensed from racks. The dispensing, now a familiar sight in many stores can be best understood by first understanding the T-shirt bags and thereafter, understanding the construction of the racks.

T-shirt bags are typically formed from endless cylinders of blown plastic. The cylinders are folded at the side edges with W folds and sealed at the top and at the bottom. Typically the sealed top of the bag is cut. It is cut so as to define paired handles on either side of the bag with the open bag mouth therebetween. Preferably the front and rear bag wall have an extending tab which forms on many overlying bags a wicket holding groups of overlying bags together.

The bag dispensing racks are likewise easy to understand. Typically, they have a rearward, vertically extending member from a load surface. The vertically extending member defines at the top a wicket supporting protrusions. A horizontally disposed U-shaped rack member holds the T-shirt bags. Such holding is typically accomplished by threading apertures in the paired handles of the T-shirt bags through the rack.

In use, the rack is typically disposed at the very edge of a counter. The two arms of the horizontally disposed U-shaped member protrude outwardly towards the edge of the rack. Bags are opened from the wicket serially one at a time. They are first opened and loaded on the rack with articles, such as grocery articles. Thereafter, the bags as loaded are removed. Typically they are removed and handed to the customer or shopper.

Grocery clerks accommodating the packing are typically highly skilled accounting personnel held to relatively high production levels in checking out and receiving payment for assorted groceries gathered by customers. The grocery clerk task requires skill and involves four discrete fields of attention.

The first of these fields of attention is the accounting register. The second field of attention is the articles to be checked. These articles are typically spread over the counter and moved between locations on the counter. The third field of attention is the bags into which the articles are packed. The final field of attention is the store patron being attended.

Unfortunately, clerks, confined to their narrow and confining counter checkout space with its at least four fields for discrete attention, are also required to stoop. Most often the required stoop is either for obtaining alternate article packing or even dropped items such as groceries or money.

Such stooping when confined to the described work environment can be hazardous. The U-shaped rack supporting the large T-shirt bags at the very edge of the counter is forgotten. When forgotten and during the stoop, poking of the person frequently results —typically in the vicinity of the eye.

It is to this problem environment that the dispensing rack of this invention is directed.

SUMMARY OF THE INVENTION

A rack for the counter edge mounting, loading and dispensing of plastic T-shirt grocery bags is disclosed. The bags are of the type formed from an endless tube of plastic having the sides of the bag with a "W" fold. The bottom and the top of the bag are sealed with the top portion cut away to define paired outside bag handles and a bag opening therebetween. The supporting rack includes a flat bottom defining a loading surface on which the sealed bottom of the grocery bag is supported during loading. A vertical or back member extends upwardly from rear portion of the loading surface and has at the top a wicket supporting protrusion—preferably a ball at the end of a wire at the end of a rod. The wicket supporting surface is for supporting bag wall tabs fused together in a wicket, the wicket holding a group of overlying bags together for sequential dispensing and loading. The rack includes a novel second U-shaped member also supported from the vertical member and placed below the first U-shaped member. This latter second U-shaped member is preferably formed of doubled over rod members and serves at least three purposes. First, it delimits the horizontal expansion of a bag being loaded on the rack it prevents the sides of the bag being loaded from expanding beyond their intended horizontal dimension. The contained articles do not rupture the bag in the horizontal dimension when the articles in the bag are carried away. Secondly, the lower rack acts as an eye safety guard; it provides an obstacle between the upper rack and the loading surface which warns clerks in stooping motions as to the presence of the immediately overlying rack. Finally, it is a secondary support surface from which smaller bags can be dispensed.

OTHER OBJECTS, FEATURES AND ADVANTAGES

An object of this invention is to disclose in combination with the first horizontally disposed U-shaped member of a T-shirt bag dispensing rack a second horizontally disposed U-shaped member. This second horizontally disposed U-shaped member provides three distinct advantages.

The first advantage is that it acts as a safety feature to the rack. Specifically, it protrudes outwardly below the first U-shaped member. A busy clerk will contact with his arm or body this rack member during a stooping motion. Upon such contact, it has been found that the clerk will deflect his head away from the rack during stooping motions. Consequently, contact with the rack is avoided.

An additional advantage of this lower rack is that it conforms the limits of outward horizontal expansion of a plastic bag being loaded. When the bag is picked up, and the sides of the bag stretched under tension, ripping of the bag is avoided. Specifically the width of the bag being packed is confined by the secondary U-shaped member. Consequently the inward force of the sides of the bag over the articles within the bag is controlled. Holes which propagate into bag destroying tears are avoided.

A final advantage of the lower guard rack is that other, typically smaller sized bags, can be dispensed. Such dispensing can either occur to the center load supporting surface or can be outward and to the side.

BRIEF DESCRIPTION OF THE DRAWINGS

Other objects, features, and advantages of this invention will become more apparent after referring to the following specification and attached drawings in which:

Referring to FIG. 3, a grocery counter 20 has a bag dispensing rack R of this invention mounted thereto. For the convenience of the reader, the rack R is shown without bags so that the invention may be more readily understood.

Figure 1:
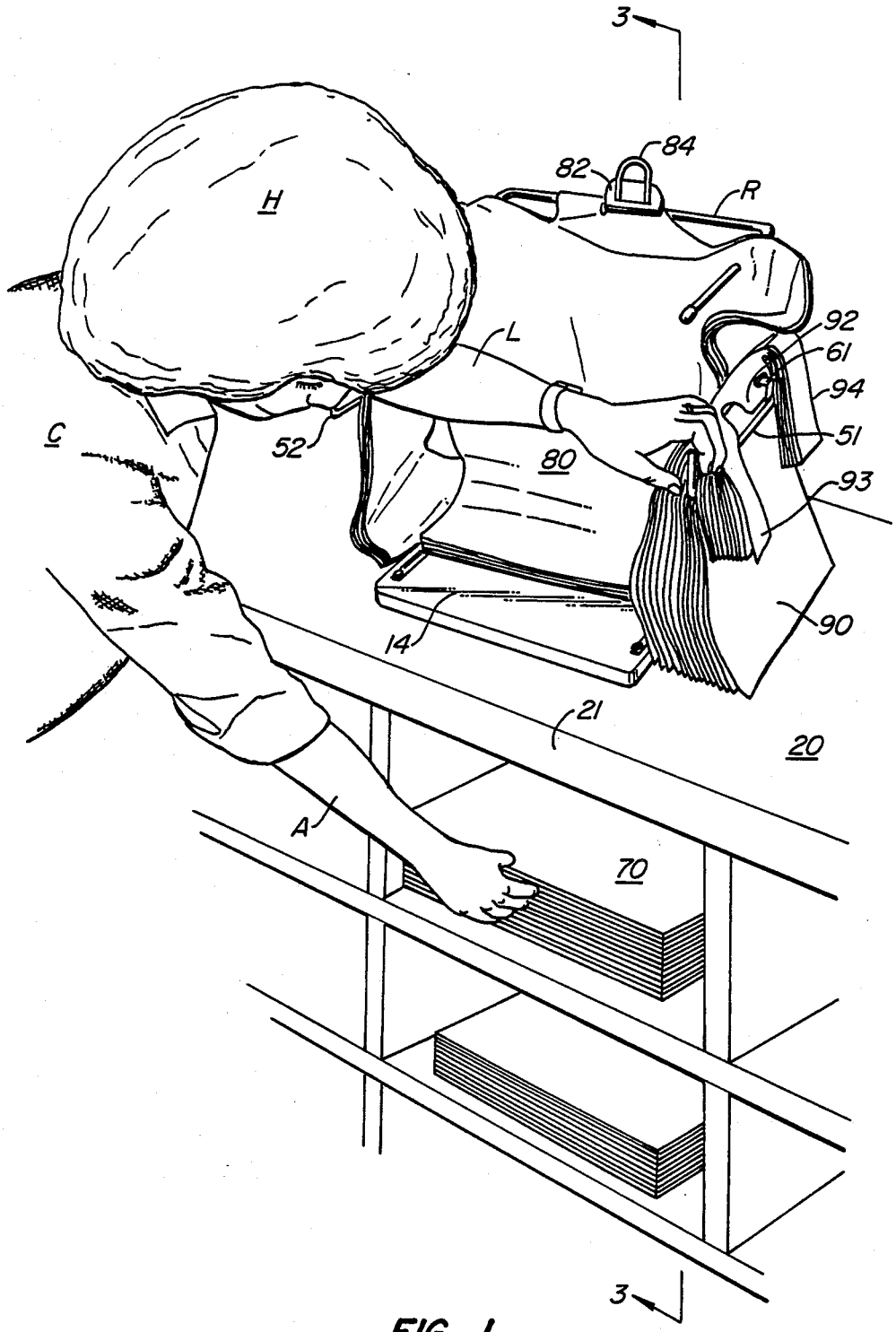
FIG. 1 a perspective view of the rack of this invention i a grocery clerk undergoing a typical stooping motion with the lower rack member making arm contact and warning of the proximity of the rack to the head of the clerk.

The rack includes a load receiving surface 14 which surface is typically placed adjacent the edge 21 of the counter 20. Paired angle brackets 24, 26 support two vertical stanchions 28, 30. Typically the stanchions are secured to the bottom of the rack via angles 31, 32 with appropriate fastenings such as screws. At the upper portion thereof there is fastened a first horizontally disposed U-shaped member 40 having respective outwardly protruding arms 41, 42. These respective outwardly protruding arms 41, 42 are the members through which the handles of the T-shirt bags are threaded.

Immediately below members 41, 42, is a second horizontally disposed U-shaped rack 50. Rack 50 includes arms 51, 52.

Studying the relation of the arms 51 to arms 41 and 52 to arms 42 several observations can be made.

Specifically, arms 51, 52 extend outwardly beyond the side edge of surface 14. Furthermore, these respective arms are longer than arms 41, 42.

Second, arms 51, 52 are slightly outside of arms 41, 42. As will hereinafter be emphasized, in this disposition, these arms are both capable of confining the sides of bags loaded within the rack as well as holding other bags for dispensing.

Arm 51 is provided with a dog 61. As will hereinafter be set forth, dog 61 enables the smaller size bags to be dispensed. These bags can be dispensed either by pulling them directly upward as when loading surface 14 is occupied with a larger bag suspended from handles 41, 42 or alternately may be loaded in the center of the load receiving surface 14 when a large bag dispensed from arms 41, 42 does not occupy the loading surface 14.

Arm 52 includes first and second bag receiving hooks 62, 63. These hooks are preferably utilized for dispensing small bags such as those that may be utilized around cold articles such as ice cream and the like. It will be noted that the location of the small "ice cream" bag is particularly handy. Specifically, and to both preserve cold article temperature and prevent leakage, it is common to wrap cold articles in the small bags. It can be seen that the small bags are dispensed to the side. When they are dispensed to the side and loaded, they may then be placed in the larger grocery bag being loaded centrally of the rack. It may thus be seen that the improved rack enables loading of more than one bag at a time.

This convenience is especially important when it is realized that such bags now are commonly dispensed from a box, usually stored below the counter. Thus, the motive and potential of an unsafe stooping motion is further reduced.

A clerk C is shown ready to stoop. This position of the clerk can best be understood with respect to the rack illustrated in FIG. 1.

Referring to FIG. 1, clerk C is shown adjacent counter 20. The clerk has reached with arm A to pick up paper bags 70 in shelving below the level of the counter top. This motion can as well be made for retrieving dropped articles.

A stooping motion is present. During this motion, the clerk has come into contact with lower arms 51, 52 with left arm L, Left arm L feeling the placement of the rack R has caused the clerk to keep her head H clear of the rack. This can best be seen with respect to the side view of FIG. 3 taken along lines 3—3 of FIG. 1.

The natural phenomenon that causes this reaction can be easily understood. When a human being maneuvers, responsive to the tactile sense instead of the visual sense, maneuvers are typically performed with the arms leading the way of the head. When the arms come in contact with an object, the head—due to the instincts of the body—never follows into the path of the arms contacting an object. Simply stated, with the addition of arms 51, head contact with the overlying and shorter arms 41, 42 is prevented.

Figure 2:
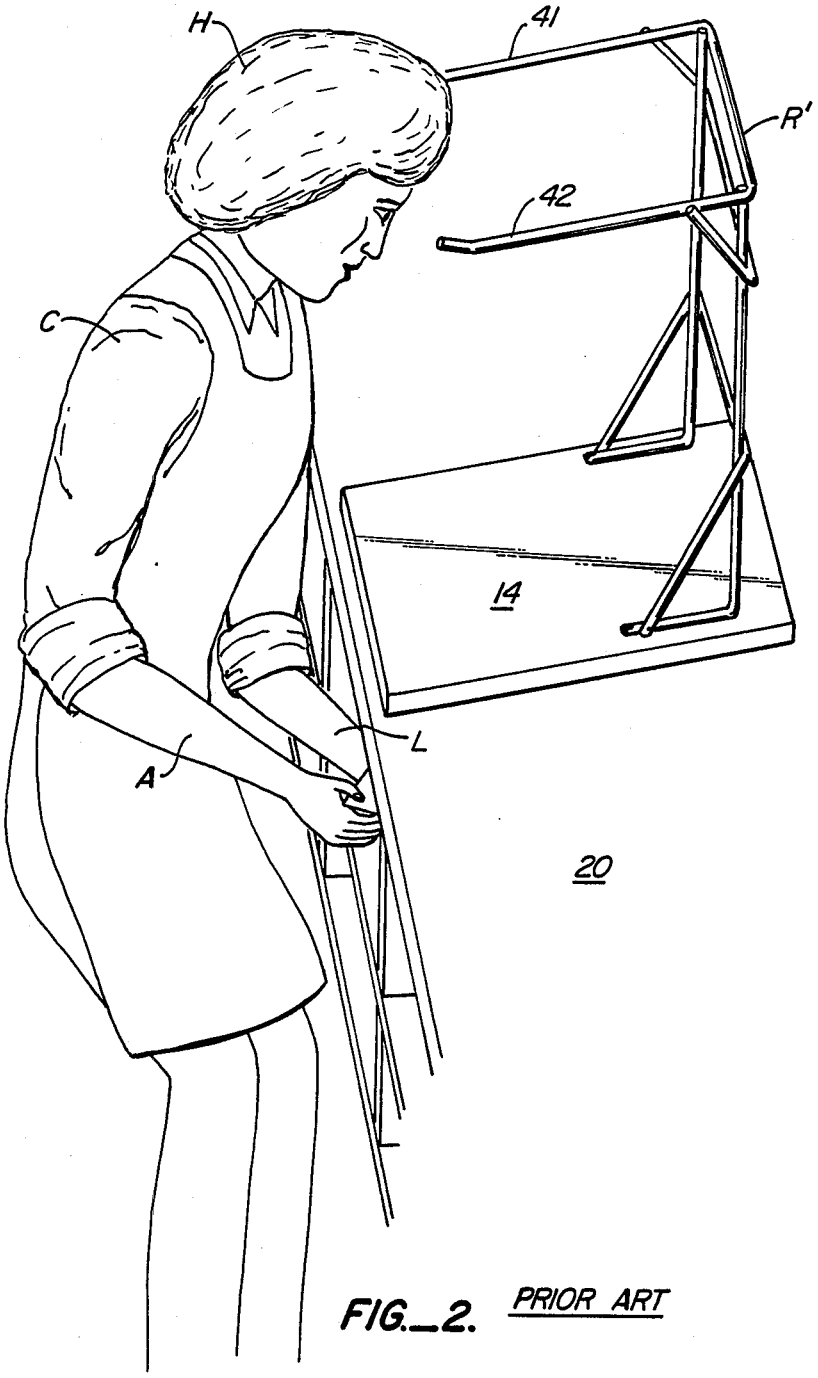
FIG. 2. PRIOR ART
FIG. 2 illustrates a prior art rack in perspective illustrating the danger presented.

Having set forth this safety characteristic of this invention, the prior art rack R′ can be contrasted therewith. Referring to FIG. 2, rack R′ is constructed in all essential details similar to rack R save and except outwardly extending arms 51, 52 are completely omitted. Referring to FIG. 2 and remembering that FIG. 2 is the same embodiment of the clerk C, it can be seen that the left arm L of the clerk has not come to rest intermediate the arms 41, 42 and the loading surface 14. Instead, the arm rests on loading surface 14. The clerk C in bending over has head contact with arm 42. Such head contact can even occur in the vicinity of the eye E.

The trap posed by the rack of FIG. 2 can be better understood when it is remembered that the typical disposition of the clerk's arms from the elbows to the hands is between loading surface 14 on the bottom and arms 41, 42 on top. Working in the confined space of the grocery counter, even the most experienced clerks can and do eventually become forgetful of the proximity of the rack R.

Figure 4:
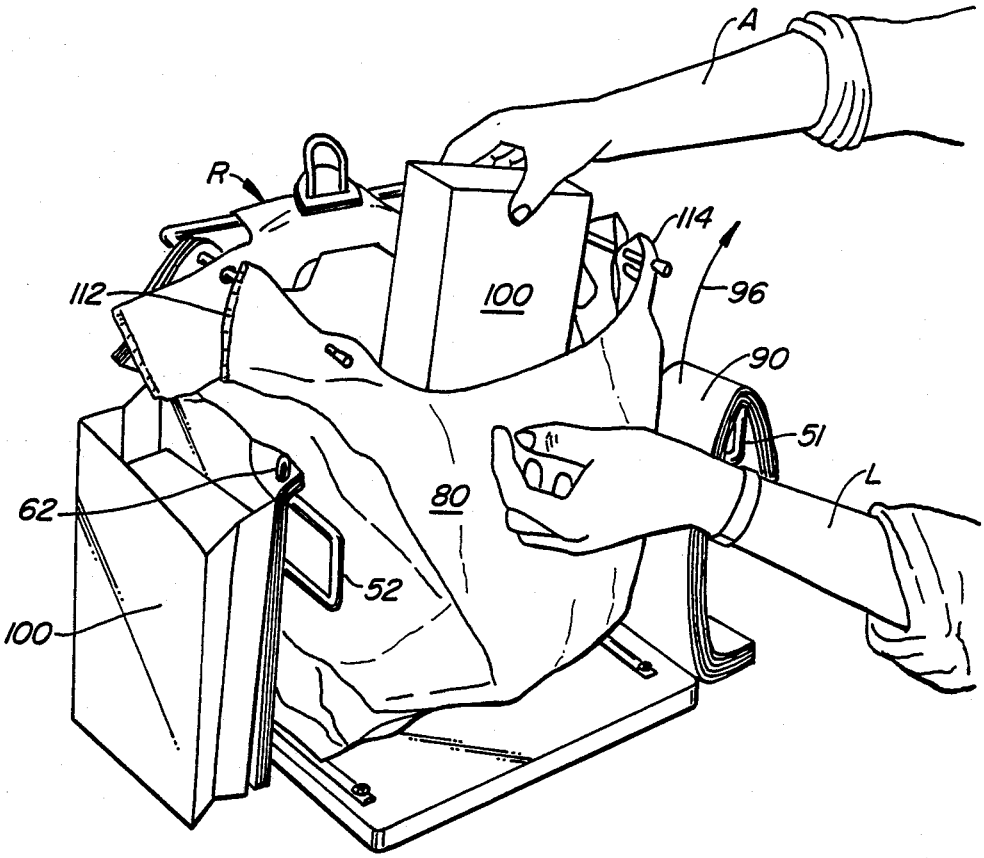
FIG. 4 illustrates the bag being placed in the rack of FIG. 1 with the lower added improved rack member delimiting the containment volume of the packed bag to avoid vertical tears and illustrates how other bags can be serially detached and opened utilizing the guard arm of this invention.

Having understood the solution first with problem second, the serendipitous additional use of the lower rack 51, 52 can be set forth with respect to the fuse of FIGS. 1 and 4.

In FIG. 1, large grocery bags 80 are shown impaled at a wicket 82 on a wicket standard 84. As such, they may readily be dispensed by the clerk C. Similarly, a smaller group of bags 90 is shown disposed on arm 51 at hook 61.

Figure 3:
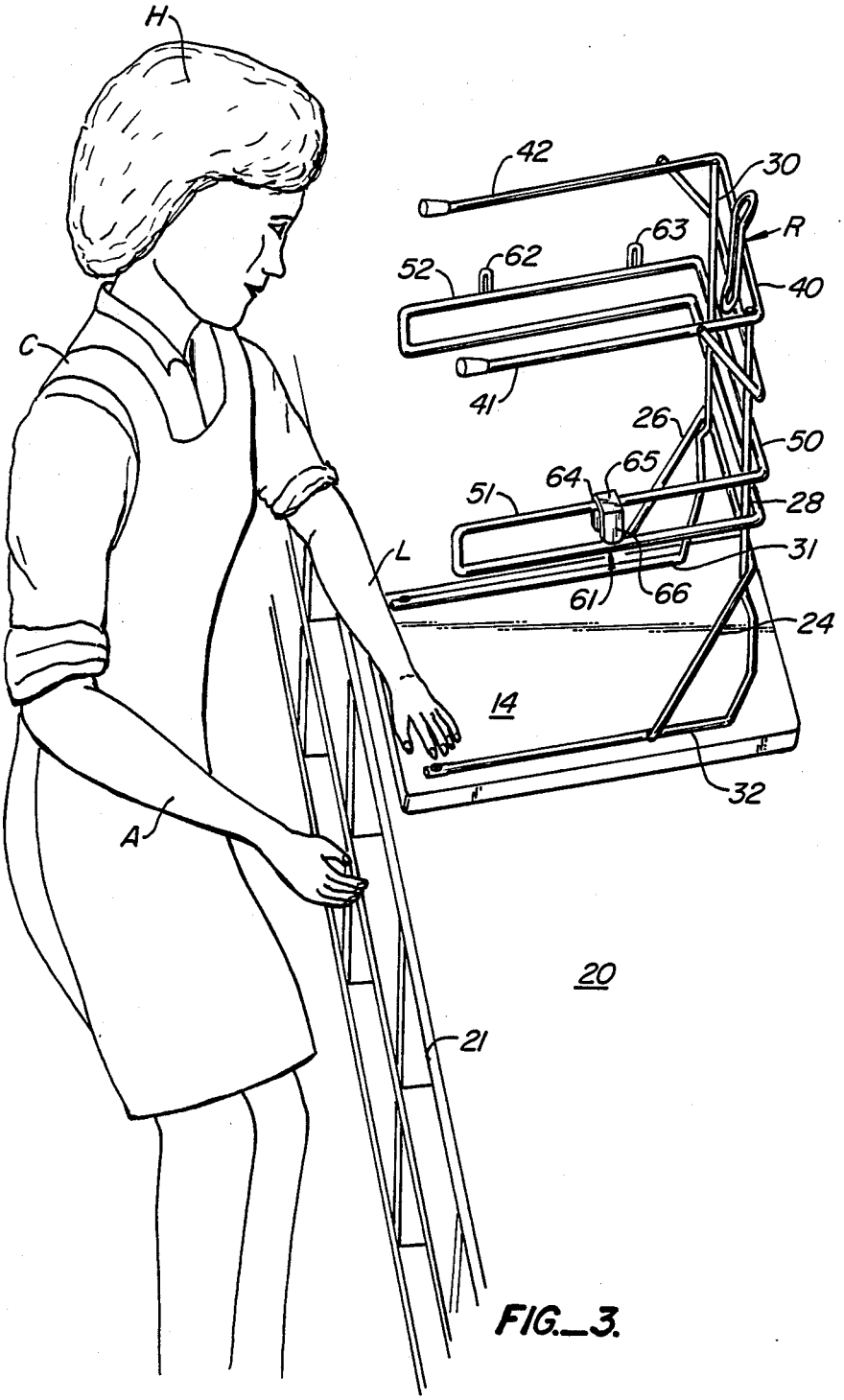
FIG. 3 is a side elevation along lines 3—3 of FIG. 1 illustrating how the lower U-shaped rack member warns of the possibility of eye contact.

Referring briefly to FIG. 3, it can be seen that hook 61 is essentially U-shaped. It has a first portion 64 extending upwardly from the U a second portion 65 extending horizontally along the U, and a third portion 66 extending downwardly.

Referring back to FIG. 1, bags 90 are placed at a wicket 92 of bonded tabs with their respective handles 93, 94 draped over the sides of the arm 51. In this disposition a clerk can readily dispense the bags to and towards the loading surface 14 for conventional loading in a manner not unlike bags 80.

Alternately, and referring to FIG. 4, bags 90 can be detached by upward movement in the direction of arrow 96. When moved upwardly the inverted U-shape of handle 66 confines the rest of the bags to their mounting. Thus, despite the presence of the large bag 80 being packed with groceries, it is still possible to serially dispense bags 90. Vending of smaller bags 100 from the remaining arm 52 is illustrated in FIG. 4.

Turning to FIG. 4, the final purpose of the arms 51, 52 can be completely understood. Specifically, the clerk at arms A and L is shown loading article 100 into an expanded bag 80. Typically, as bag 80 is loaded with many articles 100 and in the absence of arms 51, 52, horizontal expansion of the bag responsive to the volumes of the articles would be unrestrained.

Thereafter, when the bag was removed by the handles 112, 114, the bag sidewalls will come under tension. These sidewalls when under tension will contract in towards one another. When the bag sides contract one upon another, they will be forced in upon the sharp edges of articles 100 contained in the bags. If the articles transpierce the bag sides vertical and horizontal tears can propagate. At the instant that the bag is removed from the rack R, bag failure can occur.

Arms 51, 52 restrain such horizontal movement while the bag is being loaded. In the restraint of such movement, the bag 80 is not loaded overwide Not being loaded overwide when it is removed by the handles 112, 114, only normal force is exerted on the bag sidewalls when the bag sidewalls move one towards another Thus, it can be seen that the rack of this invention provides the features of preventing head contact with the outwardly protruding arms, providing additional surfaces for bag dispensing and finally, as secondary bag supports, for the loading of bagged articles.

What is claimed is:

1. A rack for holding T-shirt grocery bags of the bag type formed from an endless tube having "W" folded sides, said bags being held overlying a loading surface, a closed seal bottom, a closed seal top, cut away to provide a central opening with paired handles on either side of said central opening, the handles each being provided with apertures for threaded mounting to a dispensing rack, the dispensing rack for said T-shirt bag comprising:

a first horizontally disposed U-shaped rack having first and second outwardly extending arms, said horizontally disposed outwardly extending arms defining the end of the U and being threaded through apertures in the handles of said T-shirt bags for supporting said bag during loading of said bag on a rack;

at least one vertical member supported from said loading surface and joined to the back of said first horizontally disposed U-shaped rack at the upper end between said outwardly extending arms for holding said first horizontally disposed U-shaped member at an elevation to support the bottom of said T-shirt bag on said loading surface whereby packing of said bag with said sealed bottom resting on said loading surface can occur;

a second horizontally disposed U-shaped rack underlying said first horizontally disposed U-shaped rack, said second horizontally disposed U-shaped rack having two outwardly extending arms, each parallel to and underlying the two outwardly extending arms of said first horizontally disposed U-shaped rack, said two outwardly extending arms of said second horizontally disposed U-shaped rack protruding outwardly beyond the arms of said first horizontally disposed U-shaped member whereby said arms limit the horizontal expansion of a T-shirt bag being loaded on said rack and inhibit arm movement in the interstitial area between said first horizontally disposed U-shaped rack at the top and said loading surface at the bottom.

2. The rack of claim 1 and wherein said second horizontally disposed U-shaped rack include means for mounting secondary bags on at least one of said outwardly extending arms.

3. The rack of claim 1 and wherein said second horizontally disposed U-shaped rack includes first and second overlying U-shaped rods.

* * * * *